US008550612B2

(12) United States Patent
Park et al.

(10) Patent No.: US 8,550,612 B2
(45) Date of Patent: Oct. 8, 2013

(54) METHOD AND SYSTEM FOR INK DELIVERY AND PURGED INK RECOVERY IN AN INKJET PRINTER

(75) Inventors: Daniel Clark Park, West Linn, OR (US); Isaac S. Frazier, Portland, OR (US); David P. Platt, Newberg, OR (US); David R. Koehler, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 400 days.

(21) Appl. No.: 12/908,165

(22) Filed: Oct. 20, 2010

(65) Prior Publication Data

US 2012/0098898 A1 Apr. 26, 2012

(51) Int. Cl.
*B41J 2/18* (2006.01)
*B41J 2/185* (2006.01)
*B41J 2/175* (2006.01)

(52) U.S. Cl.
USPC ..... 347/89; 347/85; 347/90

(58) Field of Classification Search
CPC ..... B41J 2002/1856
USPC ..... 347/89
See application file for complete search history.

(56) References Cited

U.S. PATENT DOCUMENTS 4,256,470 A 3/1981 Zajicek et al.
4,314,264 A 2/1982 Bok et al.
4,320,407 A 3/1982 Goldis et al.
4,336,037 A 6/1982 Goldis et al.
4,460,903 A 7/1984 Guenther et al.
4,460,904 A 7/1984 Oszczakiewicz et al.
4,658,268 A 4/1987 Needham
4,792,292 A 12/1988 Gaenzle
5,126,752 A 6/1992 Weinberg
5,296,875 A 3/1994 Suda
5,691,753 A 11/1997 Hilton
5,956,062 A 9/1999 Omata et al.
6,139,136 A 10/2000 Mackay et al.
6,145,954 A 11/2000 Moore
6,193,363 B1 2/2001 Kelly
6,196,668 B1 3/2001 Bode
6,203,136 B1 3/2001 Takahashi et al.
6,296,353 B1 10/2001 Thielman et al.
6,302,516 B1 10/2001 Brooks et al.
6,324,898 B1 12/2001 Cote et al.
6,454,835 B1 9/2002 Baumer
6,513,918 B1 2/2003 Faisst et al.

(Continued)

FOREIGN PATENT DOCUMENTS

JP 2009-83374 A 4/2009

OTHER PUBLICATIONS

Office Action for U.S. Appl. No. 12/890,998, mailed Nov. 14, 2012, United States Patent and Trademark Office (26 pages).

(Continued)

*Primary Examiner* — Shelby Fidler
(74) *Attorney, Agent, or Firm* — Maginot, Moore & Beck, LLP

(57) ABSTRACT

An inkjet printing apparatus is provided with a one-way valve to enable a single conduit to supply ink to an ink reservoir and withdraw purged ink from a receptacle into the ink reservoir. A bi-directional pump is operated in both directions in an alternating manner to withdraw ink from the receptacle when supplying the ink reservoir with ink.

12 Claims, 6 Drawing Sheets

(56) References Cited

U.S. PATENT DOCUMENTS

| | | | | |
|---|---|---|---|---|
| 6,517,189 | B2 | 2/2003 | Ogawa et al. | |
| 6,578,948 | B2 | 6/2003 | Shima | |
| 6,698,870 | B2 | 3/2004 | Gunther | |
| 6,799,842 | B2 | 10/2004 | Barinaga et al. | |
| 6,955,423 | B2 | 10/2005 | Rodriquez Mojica et al. | |
| 6,997,972 | B2 | 2/2006 | Tseng | |
| 7,104,637 | B1 | 9/2006 | Van Steenkiste | |
| 7,150,519 | B2 | 12/2006 | Kono et al. | |
| 7,316,467 | B2 | 1/2008 | Toki | |
| 7,449,051 | B2 | 11/2008 | Olsen | |
| 7,455,387 | B2 | 11/2008 | Cunnington et al. | |
| 7,597,430 | B2 | 10/2009 | Umeda | |
| 7,611,568 | B2 | 11/2009 | Kang et al. | |
| 7,621,982 | B2 | 11/2009 | Kang et al. | |
| 7,625,080 | B2 | 12/2009 | Hess et al. | |
| 8,210,666 | B2 * | 7/2012 | Hirashima | 347/85 |
| 2003/0067518 | A1 | 4/2003 | Ishinaga et al. | |
| 2003/0197767 | A1 * | 10/2003 | Dudenhoefer et al. | 347/93 |
| 2005/0146582 | A1 | 7/2005 | Platt et al. | |
| 2005/0151798 | A1 | 7/2005 | Merz et al. | |
| 2006/0152558 | A1 | 7/2006 | Hoisington | |
| 2006/0244799 | A1 | 11/2006 | Sasa et al. | |
| 2007/0024681 | A1 | 2/2007 | Umeda | |
| 2007/0081043 | A1 | 4/2007 | Silverbrook | |
| 2008/0007601 | A1 | 1/2008 | Tsai et al. | |
| 2008/0122901 | A1 | 5/2008 | Platt et al. | |
| 2008/0273071 | A1 | 11/2008 | Brown et al. | |
| 2008/0297577 | A1 | 12/2008 | Wouters et al. | |
| 2009/0322831 | A1 | 12/2009 | Emerton et al. | |
| 2010/0097417 | A1 | 4/2010 | Hill | |
| 2010/0123764 | A1 * | 5/2010 | Slotto et al. | 347/90 |
| 2012/0044303 | A1 * | 2/2012 | Park | 347/85 |

OTHER PUBLICATIONS

Amendment in Response to Office Action for U.S. Appl. No. 12/890,998, submitted Jan. 14, 2013 (12 pages).

Office Action for U.S. Appl. No. 12/861,177, mailed Jan. 2, 2013, United States Patent and Trademark Office (12 pages).

Amendment in Response to Office Action for U.S. Appl. No. 12/861,177, submitted Mar. 21, 2013 (10 pages).

* cited by examiner

METHOD AND SYSTEM FOR INK DELIVERY AND PURGED INK RECOVERY IN AN INKJET PRINTER

TECHNICAL FIELD

This disclosure relates generally to systems that supply and recover fluid from a device, and more particularly, to an inkjet printer configured to supply liquid ink to an ink reservoir within an inkjet printing apparatus and recover liquid ink from a receptacle associated with the inkjet printing apparatus.

BACKGROUND

Fluid transport systems are well known and used in a number of applications. One specific application of transporting a fluid in a machine is the transportation of ink in a printer. Common examples of inks include aqueous inks and phase change or solid inks. Aqueous inks remain in a liquid form when stored prior to being used in imaging operations. Solid ink or phase change inks typically have a solid form, either as pellets or as ink sticks of colored cyan, yellow, magenta and black ink, that are inserted into feed channels in a printer through openings to the channels. After the ink sticks are fed into the printer, they are urged by gravity or a mechanical actuator to a heater assembly of the printer. The heater assembly includes a heater and a melt plate. The heater, which converts electrical energy into heat, is positioned proximate the melt plate to heat the melt plate to a temperature that melts an ink stick coming into contact with the melt plate. The melt plate may be oriented to drip melted ink into a reservoir and the ink stored in the reservoir continues to be heated while awaiting subsequent use.

Each reservoir of colored, liquid ink may be fluidly coupled to an inkjet printing apparatus. The liquid ink is pumped from the reservoir to a manifold in the inkjet printing apparatus. As the inkjet ejectors in the inkjet printing apparatus eject ink onto a receiving medium or imaging member, the action of the diaphragms in the inkjet ejectors pull ink from the manifold. The inkjet ejectors may be piezoelectric devices that are selectively activated by a controller with a driving signal.

Conduits typically employed in transporting ink between a reservoir and one or more inkjet ejectors may be referred to as "umbilicals". An umbilical is a flexible conduit fluidly coupled to an inkjet printing apparatus at one end and one or more ink supplies at another end. An umbilical may contain one or many separate channels for transporting fluids such as ink. Typical prior art umbilical assemblies include one or more conduits formed from a flexible material, such as extruded silicone, for example. During operation, the delivery conduits are filled with ink so as to avoid inserting air bubbles into the inkjet ejectors. Air bubbles suspended in ink supplying the jet stack may cause ejector misfires during imaging operations.

During maintenance and cleaning operations, ink within an inkjet printing apparatus may be purged through the inkjet ejectors. A receptacle or catch may be used to capture and hold the purged ink. The receptacle is emptied after a purge operation by pulling the ink out of the receptacle through another conduit to which a negative pressure source has been applied. The collected purged ink may be directed to the reservoir to enable the ink to be returned to the inkjet printing apparatus. The efficient collection and transfer of purged ink is important in inkjet printers.

SUMMARY

An inkjet printing apparatus configured to have an ink reservoir in selective fluid communication with a receptacle has been developed. The inkjet printing apparatus includes an ink reservoir for storing liquid ink, a plurality of inkjet ejectors in fluid communication with the ink reservoir, a receptacle mounted proximate to the plurality of inkjet ejectors, the receptacle having an opening configured to receive ink purged from the plurality of inkjet ejectors and the receptacle having an outlet fluidly connected to the ink reservoir, a one-way valve positioned at the outlet of the receptacle, and a port in the ink reservoir that is configured to enable a negative pressure to be generated within the ink reservoir to operate the one-way valve and pull ink from the receptacle into the ink reservoir through the outlet of the receptacle. Each inkjet ejector is configured to receive ink from the ink reservoir and eject ink from an aperture formed in each inkjet ejector. The one-way valve is configured to enable the ink in the receptacle to flow into the ink reservoir and to resist a flow of ink from the ink reservoir into the receptacle through the outlet of the receptacle.

A system for delivering liquid ink in an inkjet printing apparatus has been developed. The system includes an inkjet printing apparatus configured with an ink reservoir for storing liquid ink to be ejected by the inkjet printing apparatus, a plurality of inkjet ejectors in fluid communication with the ink reservoir, each inkjet ejector configured to receive ink from the ink reservoir and eject ink from an aperture formed in each inkjet ejector, a receptacle mounted proximate to the plurality of inkjet ejectors that is configured to receive ink purged from the ink reservoir through the plurality of inkjet ejectors, the receptacle having an outlet that is fluidly connected to the ink reservoir, a one-way valve positioned in the outlet of the receptacle, a container of liquid ink having an inlet to receive liquid ink and an outlet to supply the liquid ink to the ink reservoir, a conduit, a pump operatively connected to the conduit and configured for reversible operation, and a controller operatively connected to the pump. The ink reservoir has a port that enables ink to flow into the ink reservoir and ink to be pulled from the ink reservoir. The one-way valve is configured to enable the ink in the receptacle to flow into the ink reservoir and to resist a flow of ink from the ink reservoir into the receptacle through the outlet of the receptacle. The conduit is fluidly connected to the port of the ink reservoir and to the outlet of the liquid ink container. The controller is configured to operate the pump in a first direction to supply ink from the container of liquid ink to the ink reservoir through the port and to operate the pump in the second direction to generate negative pressure at the port of the ink reservoir to open the one-way valve and pull ink from the receptacle into the ink reservoir through the outlet of the receptacle.

A method of supplying ink to an inkjet printing apparatus has been developed. The method includes operating a pressure source in a first mode to pump ink into an ink reservoir that stores liquid ink to be ejected by an inkjet printing apparatus for a first predetermined period of time, and operating the pressure source in a second mode to apply a negative pressure to an outlet of a receptacle for a second predetermined period of time in response to operation of the pressure source in the first mode.

In at least another embodiment, an inkjet printing apparatus has been developed. The apparatus includes an ink reservoir for storing liquid ink, a plurality of inkjet ejectors in fluid communication with the ink reservoir, a receptacle mounted proximate to the plurality of inkjet ejectors, an ink supply fluidly connected to the receptacle through a first one way valve, a port in the ink reservoir that fluidly connects the ink reservoir to the ink supply to enable ink in the ink supply to be pumped into the ink reservoir, a pressure source operatively connected to the ink supply and the first one-way valve, and a controller operatively connected to the pressure source. Each inkjet ejector is configured to receive ink from the ink reservoir and eject ink from an aperture formed in each inkjet ejector. The receptacle has an opening configured to receive ink purged from the plurality of inkjet ejectors. The first one-way valve is configured to resist a flow of ink from the ink supply into the receptacle through the outlet. The controller is configured to operate the pressure source in a first direction to pump ink from the ink supply into the ink reservoir for a first predetermined time period and to operate the pressure source in a second direction to pull ink from the ink receptacle through the first one-way valve for a second predetermined period of time.

DETAILED DESCRIPTION

Figure 1:
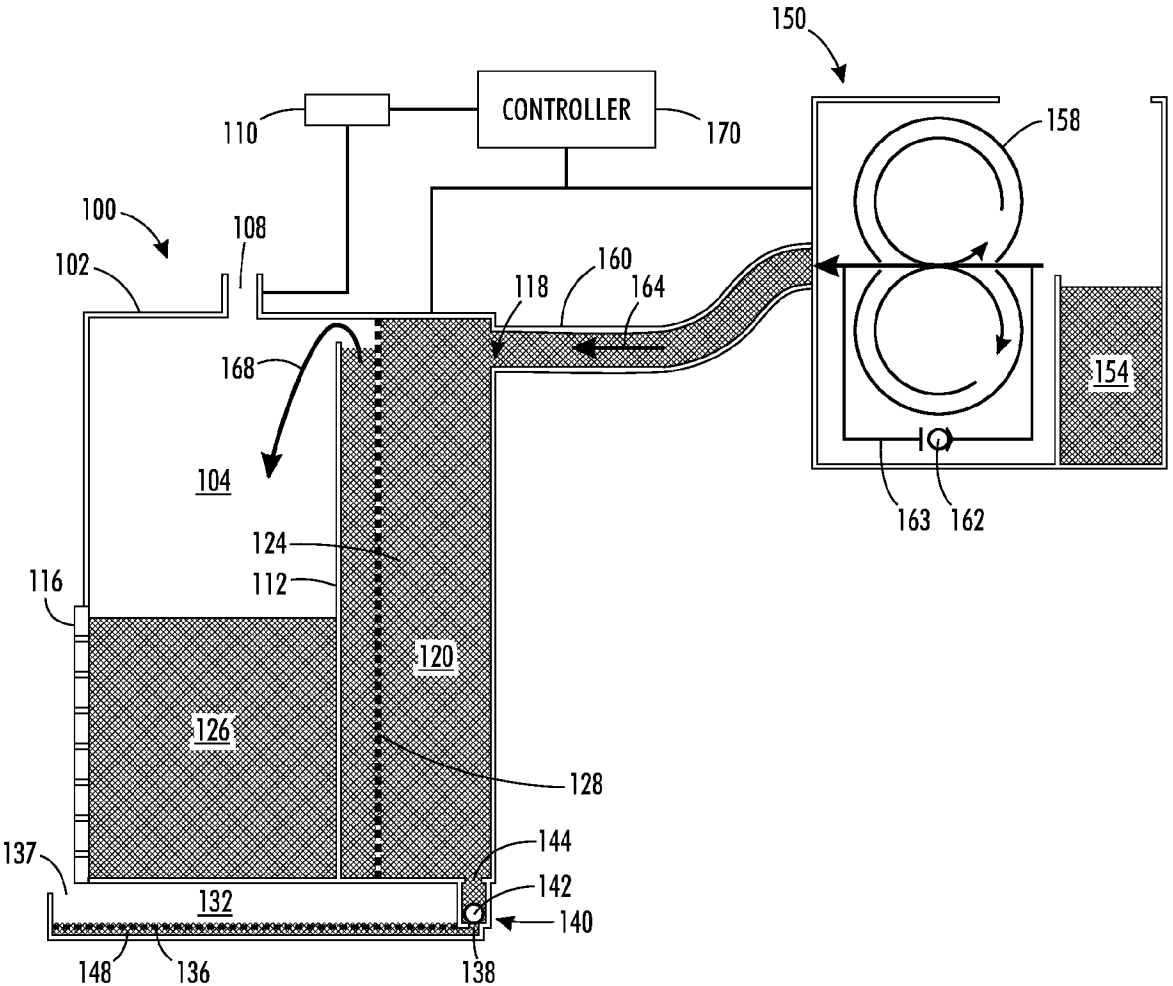
FIG. 1 is a schematic diagram of an inkjet printing apparatus with a pressurized filter configuration including a receptacle operatively connected to an ink inlet chamber by a check valve.

For a general understanding of the environment for the system and method disclosed herein as well as the details for the system and method, reference is made to the drawings. In the drawings, like reference numerals have been used throughout to designate like elements. The term "meniscus strength" refers to an attraction of a liquid, such as ink, to a material surrounding an opening in a material, such as a pore in a membrane, positioned across a path for the liquid. The meniscus strength holds the liquid in the pore until a higher pressure is reached that breaks the liquid attraction to the membrane material and pulls gas through the pore. Consequently, a membrane having wetted pores enables liquids to be pulled through the pores of the membrane while preventing a gas from passing through the membrane as long as the pressure across the wetted pores remains below the pressure that breaks the meniscus. The term "weir" refers to a wall positioned within a chamber that is as wide as the chamber, but not as tall as the chamber. Thus, liquid builds behind the weir until it reaches the top of the weir and then overflows into the chamber. In this manner, the liquid level on the two sides of the weir may be maintained at different heights. The term "conduit" refers to a body having a passageway or lumen through it for the transport of a liquid or a gas. As used herein, "purging ink" refers to any emission of ink from an inkjet ejector that does not land on an image receiving member whether deliberate or accidental. Purged ink refers to ink emitted from the ejector during purging.

Referring to FIG. 1, an inkjet printing apparatus 100 having a pressurized filter configuration that is operatively connected to an external ink supply 150 is depicted. Inkjet printing apparatus 100 includes a manifold chamber 104, vent 108, weir 112, inkjet ejectors 116, inlet chamber 120, and an ink receptacle 132 mounted proximate to the inkjet ejectors 116. An actuator 110 such as a solenoid is positioned at an opening of vent 108, and the actuator 110 opens during printing operations to allow an outside gas such as air to enter the manifold 104. When vent 108 is opened, pressure along the inkjet ejectors 116 is equalized, allowing ink supply 126 in manifold 104 to replenish inkjet ejectors 116 during printing operations. Inkjet ejectors 116 are shown in direct fluid communication with manifold 104 in FIG. 1, but in various alternative embodiments the ejectors can be somewhat distant from the manifold 104 and may be coupled to an ink supply through various conduits and intermediate chambers. Manifold 104 holds ink 126 until the action of the diaphragms in the inkjet ejectors 116 produce negative pressure that pulls ink 126 from the manifold 104 into the inkjet ejectors 116 and then ejects the ink through apertures in the inkjet ejectors 116. The ejectors 116 are formed with an inkjet ejector stack as is well known in the art. Ink purged through the inkjet ejectors in a manner described more fully below, flows down from the apertures and is collected in the receptacle 132.

Ink inlet chamber 120 includes a port 118, a weir 112, and a reservoir filter 128. Ink inlet chamber 120 may be placed in fluid communication with a conduit such as conduit 160 through port 118 through the side of inlet chamber 120. Reservoir filter 128 is placed between weir 112 and port 118. In the embodiment of FIG. 1, reservoir filter 128 is a membrane including a plurality of pores with each pore being approximately 10 μm in size, and the reservoir filter 128 extends across the entire width and height of the ink inlet chamber 120. Weir 112 extends upwards between ink inlet chamber 120 and manifold 104, and maintains a higher level of ink 124 in the ink inlet chamber 120 than the level of ink 126 in manifold 104. The ink inlet chamber 120 is fluidly coupled to receptacle 132 via a one-way valve 140.

Receptacle 132 is mounted proximate to inkjet ejectors 116, and includes a receptacle ink inlet 137 with a receptacle filter 136 extending across an opening between receptacle inlet 137 and an outlet 138. Ink purged from manifold 104 through inkjet ejectors 116 flows into the receptacle 132 through receptacle inlet 137. Receptacle filter 136 may be formed from a porous membrane having pores of a similar size to the pores in reservoir filter 128. One-way valve 140 is positioned over outlet 138, and is configured to permit ink to flow from receptacle 132 into the ink inlet chamber 120. The one-way valve 140 includes a ball 142 and a valve opening 144 formed in a wall of the ink inlet chamber 120. In the configuration of FIG. 1, gravity pulls ball 142 down to cover outlet 138 of the receptacle 132 and impede the flow of ink 124 from the inlet chamber 120 into the receptacle 132. The one-way valve 140 is configured to allow ink to flow from the receptacle 132 to the ink inlet chamber 120 when a negative pressure sufficient to unseat the ball 142 is applied to port 118. The amount of negative pressure needed to unseat the ball 142 is determined, at least in part, by the diameter of the outlet 138. In the configuration of FIG. 1, the one-way valve 140 is closed, with the ball 142 seated in the outlet 138. In this configuration, ink from ink inlet chamber 120 is blocked from flowing into the receptacle 132.

The one-way valve 140 enables purged ink to be returned to the ink reservoir of the inkjet printing apparatus 100. Consequently, a second conduit fluidly coupling the receptacle 132 to the ink supply 150 is not needed. Thus, the structure of the inkjet printing apparatus 100 is more efficient than previously known inkjet printing apparatuses. In practical embodiments, however, the efficiency provided by one-way valve 100 may be offset by leakage into the external ink reservoir through the one-way valve 140 from the ink inlet chamber 120. This leakage may occur from the range of mechanical tolerances for the components used to manufacture one-way valves of the size required in inkjet printheads.

An external ink supply 150 is operatively connected to the inkjet printing apparatus 100 via conduit 160, which may be an ink umbilical. External ink supply 150 includes an ink reservoir 154 and a pump 158. The ink reservoir 154 is in fluid communication with conduit 160 and the pump 158 is configured to operate in a forward direction and a reverse direction. That is, pump 158 may be operated in one direction to produce positive pressure to expel ink from the supply 150 through the conduit 144 into the inlet chamber 120 and in the opposite direction to produce negative pressure to pull ink from either inlet chamber 120 and/or receptacle 132. In aqueous ink printers, the liquid ink may be held in an ink cartridge, while in phase change ink printers, solid ink may be liquefied using a heated melt plate and fed to reservoir 152. Pump 158 is shown operating in the forward direction in FIG. 1, where the forward direction supplies ink from external ink supply 150 to inkjet printing apparatus 100 via conduit 160. In the embodiment of FIG. 1, pump 158 is a gear pump, although alternative pumps configured to pump in the forward and reverse directions may be used.

Ink is pumped to and from external ink supply 150 under pressure, and the level of negative pressure applied to the ink by pump 158 is maintained at predetermined levels while operating external ink supply 150. The level of negative pressure is sufficient to withdraw ink from inkjet printing apparatus 100, while being lower than the pressure needed to draw air past filters 128 and 136, as discussed in further detail below. The external ink supply 150 may include a bypass relief valve 162 operatively coupled to the fluid path of pump 158. A bypass relief path 163 restricts the flow of ink from ink inlet chamber 120 to external ink supply 150 when bypass relief valve 162 opens in response to negative pressure applied by pump 158. Bypass relief path 163 and bypass relief valve 162 act as a flow restrictor that establishes a predetermined negative pressure level for the pump 158 that is below the pressure needed to draw air past filters 128 and 136. One such bypass relief valve is described in further detail in copending application Ser. No. 12/847,829, entitled "LIQUID INK DELIVERY SYSTEM INCLUDING A FLOW RESTRICTOR THAT RESISTS AIR BUBBLE FORMATION IN A LIQUID INK RESERVOIR," which was filed on Jul. 30, 2010, and has a common assignee to the present application. Other devices and control methods may also be used to regulate the pressures, both negative and positive, produced by the pump 158.

In operation, the pumping action of pump 158 applies positive pressure to ink in conduit 160 through port 118 into ink inlet chamber 120. The positive pressure is sufficient to urge additional ink into ink supply 124, which substantially fills ink inlet chamber 120. As additional ink is added to ink supply 124 under positive pressure, excess ink passes through reservoir filter 128 and flows over the top of weir 112 into the ink manifold 104 in direction 168. One-way valve 140 may allow a quantity of ink to leak into ink receptacle 132 forming ink 148. The pump 158 may operate in a reverse direction for a predetermined time period to apply a negative pressure to withdraw the ink 148 from the ink receptacle 132.

The operations of components in inkjet printing apparatus 100 and external ink supply 150 including, but not limited to, opening and closing the actuator 110 of vent 108, operating pump 158, and operating inkjet ejectors 116 are governed by a controller 170. Typical embodiments of the controller 170 include a microprocessor device such as a central processing unit (CPU), an application specific integrated circuit (ASIC), a field programmable device, or a microcontroller. Controller 170 may operate the inkjet printing apparatus 100 and external ink supply 150 in accordance with software or firmware commands. Various printing devices may employ one or multiple electronic devices providing the functionality of controller 170. The controller is configured with electrical components and programmed instructions stored in memory operatively connected to the controller to perform the functions described in this document along with other known functions for operating an inkjet printer.

Figure 2:
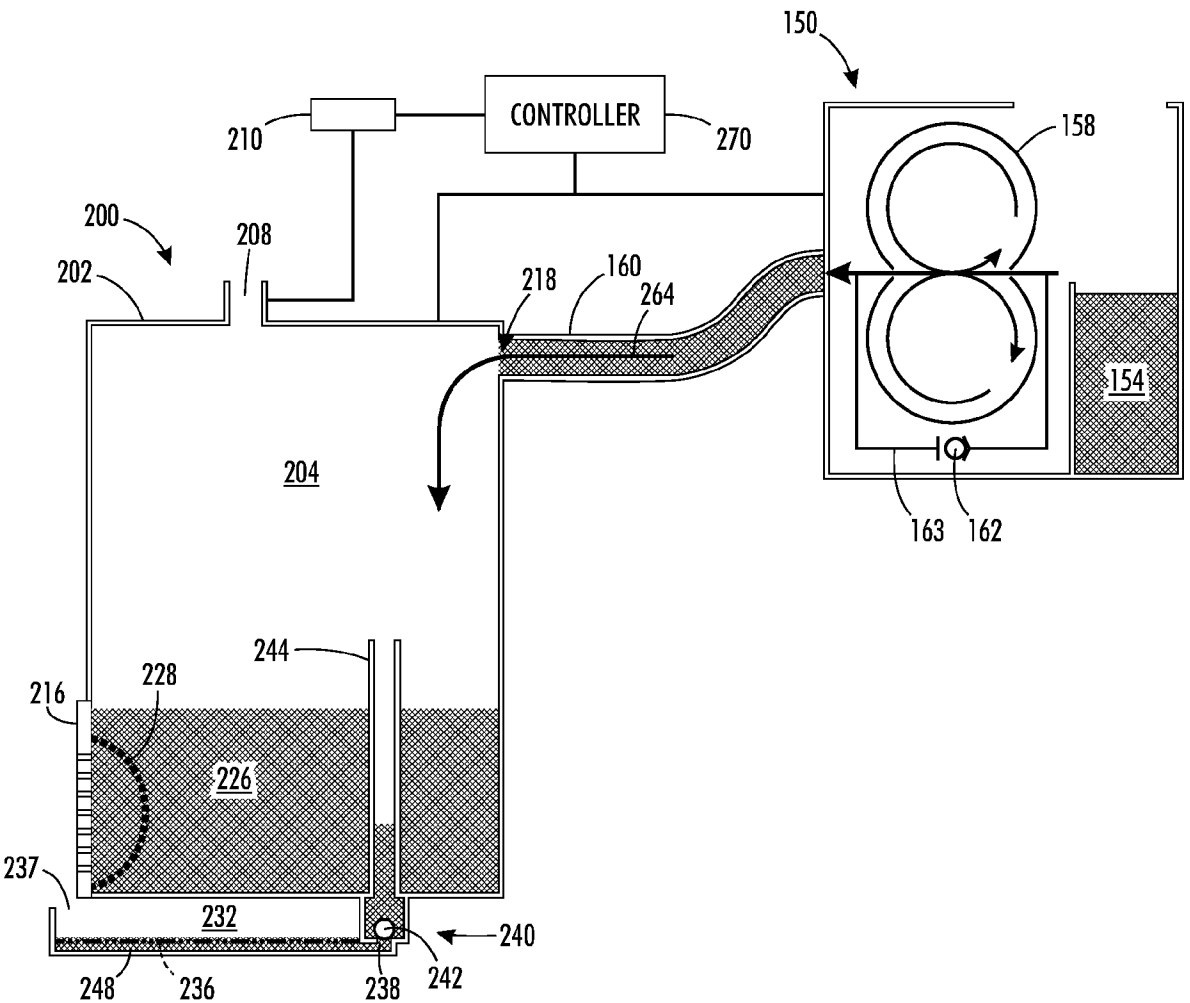
FIG. 2 is a schematic diagram of an inkjet printing apparatus with a non-pressurized filter configuration including a receptacle operatively connected to an ink manifold by a check valve.

Referring to FIG. 2, an inkjet printing apparatus 200 having a non-pressurized filter configuration that is operatively connected to an external ink supply 150 is depicted. Inkjet printing apparatus 200 includes a manifold chamber 204, port 218, vent 208, inkjet ejectors 216, reservoir filter 228, and an ink receptacle 132 mounted externally to the manifold chamber 204. Reservoir filter 228 is interposed between inkjet ejectors 216 and port 218. Reservoir filter 228 is a membrane having a plurality of pores approximately 10 μm in diameter. An actuator 210, such as a solenoid, is positioned at an opening of vent 208, and is opened during printing operations to allow an outside gas, such as air, to enter the manifold 204. When vent 208 is opened, pressure along the inkjet ejectors 216 is equalized, allowing ink supply 226 in manifold 204 to replenish inkjet ejectors during printing operations. Inkjet ejectors 116 are shown in direct fluid communication with manifold 104 in FIG. 1, but in various alternative embodiments the ejectors can be somewhat distant from the manifold 104 and may be coupled to an ink supply through various conduits and intermediate chambers. Manifold 204 holds ink 226 until the action of the diaphragms in the inkjet ejectors 216 produce negative pressure that pulls ink 226 from the manifold 204 into the inkjet ejectors 216 and then ejects the ink through apertures in the inkjet ejectors 216. The ejectors 216 are formed with an inkjet ejector stack as is well known in the art. Ink purged through the inkjet ejectors 216 in a manner described more fully below, flows down from the apertures and is collected in the receptacle 232.

Receptacle 232 is proximate to inkjet ejectors 216, and includes a receptacle filter 236 placed between a receptacle inlet 237 and an outlet 238. In the embodiment of FIG. 2, filter 236 is a membrane having a plurality of pores approximately 70 μm in diameter. A one-way valve 240 allows ink in the receptacle 232 to be pumped through an internal conduit 244 into ink manifold 204, while impeding ink from flowing into receptacle 232 through outlet 238. One-way valve 240 includes a ball 242 which is seated over outlet 238 and held in place by gravity in the closed position seen in FIG. 2. In the embodiment of FIG. 2, internal conduit 244 extends upward from the one-way valve 240 above the level of ink 226 in the manifold 204. The internal conduit 244 prevents ink 226 from coming into contact with the one-way valve 240. Internal conduit 244 may be omitted from alternative inkjet printing apparatus embodiments. A quantity of ink held in internal conduit 244 may leak back through the valve as seen by ink 248 in the ink receptacle 232, and some or all of ink 248 may be withdrawn by reverse action of pump 158.

The external ink supply 150 of FIG. 2 is the same as the external ink supply of FIG. 1, including reservoir 154, pump 158, and bypass relief valve 162, although alternative external ink supplies for non-pressurized inkjet printing apparatuses may be used as well. For example, a smaller capacity pump may used to supply ink to a non-pressurized inkjet printing apparatus since there is no need to pump ink with pressure sufficient to overcome a weir or the like. Both the pressurized inkjet printing apparatus 100 and non-pressurized inkjet printing apparatus 200 are placed in fluid communication with the external ink supply 150 via the single conduit 160. Additionally, while the external ink supply 150 is depicted as being above ports 118 and 218 in inkjet printing apparatuses 100 and 200, respectively, the external ink supply 150 may be located above or below the inkjet printing apparatus in operation. In FIG. 2, pump 158 operates in the forward direction pumping ink from reservoir 154 through conduit 160 in direction 264, where the ink passes through port 218 and joins ink supply 226 in the manifold 204.

A controller 270 governs the operations of components in inkjet printing apparatus 200 and external ink supply 150 including, but not limited to, opening and closing the actuator 210 of vent 208, operating pump 158, and operating inkjet ejectors 216. Typical embodiments of the controller 270 include a microprocessor device, such as a central processing unit (CPU), an application specific integrated circuit (ASIC), a field programmable device, or a microcontroller. Controller 270 may use the same or similar electronic components to that of controller 170 in FIG. 1 in a configuration suitable for operation with the non-pressurized inkjet printing apparatus 200.

Figure 3:
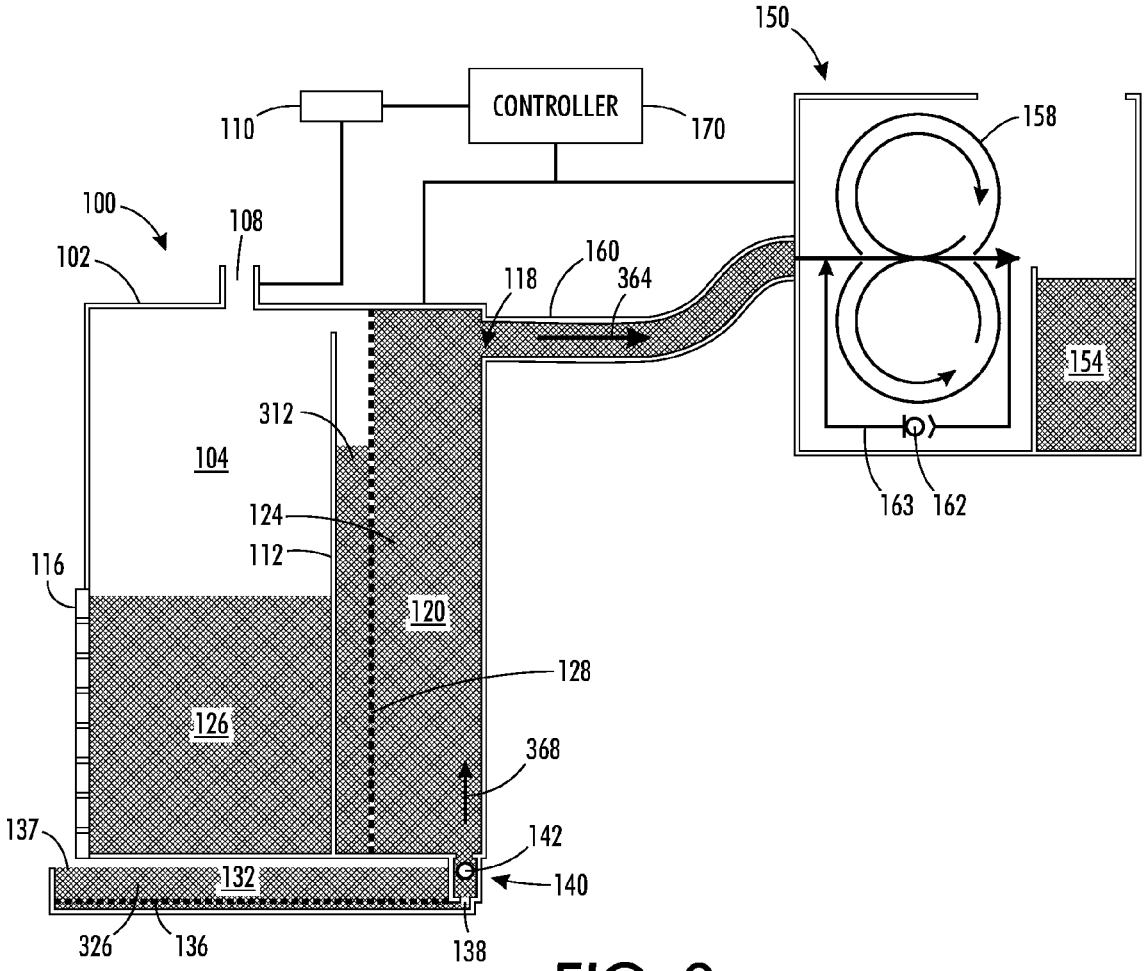
FIG. 3 is a schematic diagram of the inkjet printing apparatus of FIG. 1 including ink in a receptacle being reclaimed after a purge operation.

Referring to FIG. 3, inkjet printing apparatus 100 and external ink supply 150 are depicted reclaiming purged ink. During a purge operation, ink from manifold 104 is driven from inkjet printing apparatus 100 through inkjet ejectors 116. During the purge operation, the solenoid actuator 110 of vent 108 may be closed as ink is urged through the ejectors in the inkjet printing apparatus by pressure supplied to the manifold 104 of the inkjet printing apparatus. Unlike normal imaging operations in which ink is ejected away inkjet ejectors 116 in the form of drops, the purged ink flows down the apertures of inkjet ejectors 116 into the receptacle inlet 137 and into receptacle 132. Receptacle 132 collects purged ink 326 for reclamation.

In order to reclaim the purged ink 326, controller 170 operates pump 158 in the reverse direction seen in FIG. 3, applying negative pressure to withdraw ink from inkjet printing apparatus 100. The negative pressure applied by pump 158 is sufficient to withdraw ink 124 from the ink inlet chamber 120 through port 118. Ink withdrawn through port 118 may be introduced into ink reservoir 154. During withdrawal, some or all of the ink volume behind the weir 112 may be withdrawn, as shown in FIG. 3 by ink 312 partially covering one side of weir 112. As ink is withdrawn from the weir 112, the surface area of reservoir filter 128 contacting ink in weir 112 decreases, and the negative pressure needed to withdraw ink from behind weir 112 exceeds the negative pressure needed to open one-way valve 140. One-way valve 140 opens in response to the negative pressure, with ball 142 pulled out of outlet 138 in direction 368. Once one-way valve 140 is opened, purged ink 326 is withdrawn into the ink inlet chamber 120. A similar operation may be performed to withdraw ink held in receptacle 132 during operation.

The negative pressure applied by pump 158 is selected to be sufficient to withdraw ink from the receptacle 132, and less than a pressure that would draw gas into the ink 124 held in the ink inlet chamber 120. Ink in the inlet chamber 120 held between port 118 and reservoir filter 128 wets filter 128. Ink in the receptacle 132 held between filter 136 and outlet 138 wets filter 136. The ink meniscus maintained across each pore in filters 128 and 136 impedes outside gas, such as air, from passing into the ink mass 124 held in the ink inlet 120. For the example pressurized inkjet printing apparatus 100, pump 158 withdraws ink with a pressure in a range from above about 0.3 psi to below about 0.6 psi. The lower pressure bound is determined by the negative pressure needed to open the one-way valve 140, and the higher pressure bound is determined by the meniscus strength of ink on the reservoir filters.

Figure 4:
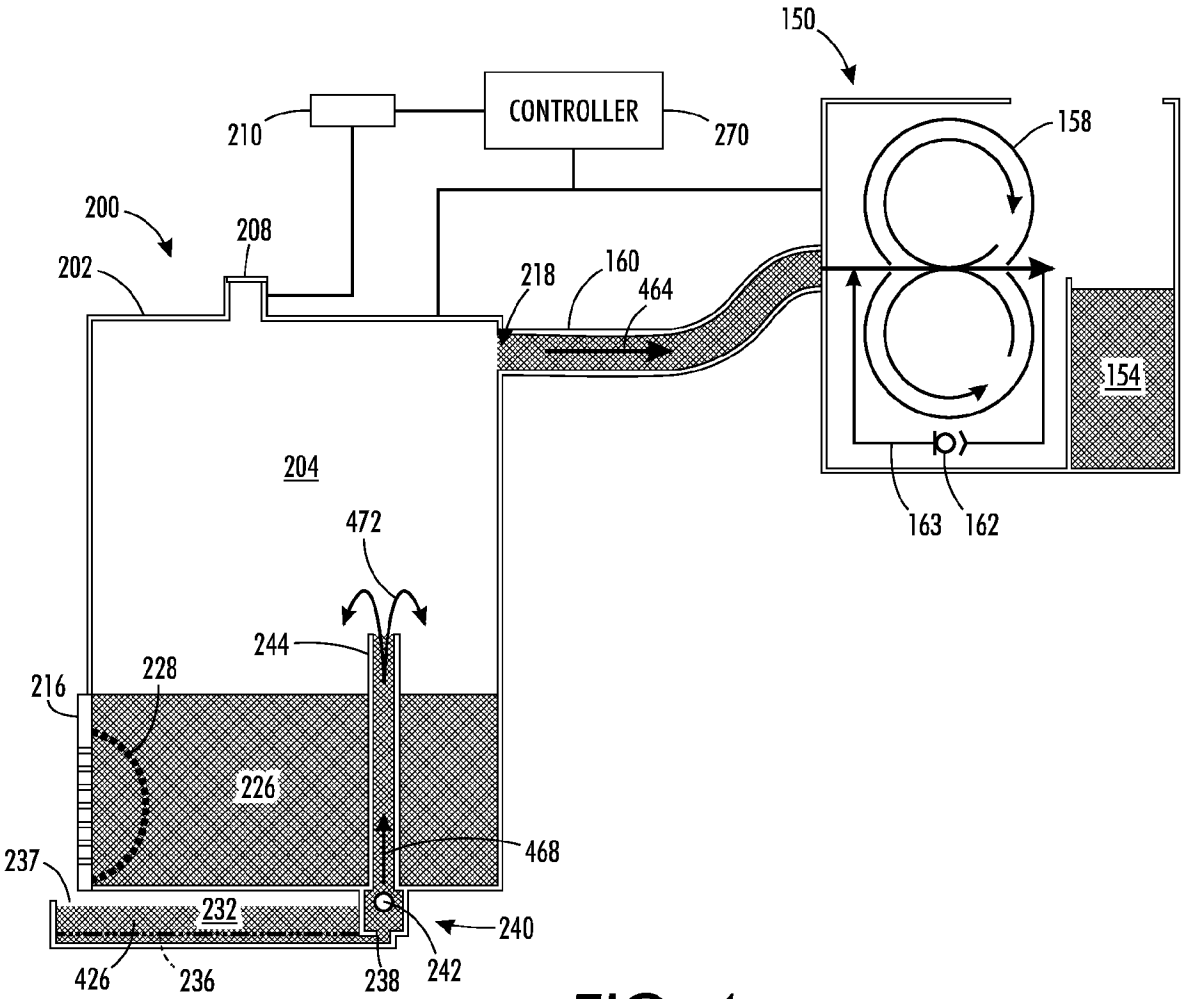
FIG. 4 is a schematic diagram of the inkjet printing apparatus of FIG. 2 including ink in a receptacle being reclaimed after a purge operation.

Referring to FIG. 4, inkjet printing apparatus 200 and external ink supply 150 are depicted in operation reclaiming purged ink 426. Ink in manifold 204 is purged through inkjet ejectors 216, and the ink subsequently flows into the receptacle 232 through opening 237. Receptacle 232 holds purged ink 426 for reclamation.

In order to reclaim the purged ink 426, controller 270 operates pump 158 in the reverse direction seen in FIG. 4, applying a negative pressure to withdraw gas from manifold 204 through port 218. The gas, typically air, is pumped through conduit 160 in direction 464 and is directed away from ink reservoir 154 so as to prevent air bubbles from forming in ink held in ink reservoir 154. As air is removed from manifold 204, a partial vacuum is formed. The actuator 210 maintains vent 208 in the closed position in FIG. 4. Additionally, ink wetting reservoir filter 228 forms a meniscus that resists a flow of air from inkjet ejectors 216 into the manifold 204, with a higher relative resistance pressure than the pressure needed to open one-way valve 240. Thus, the partial vacuum in manifold 204 pulls ball 242 upwards in direction 468, opening one-way valve 240. Purged ink 426 is withdrawn from the receptacle 232 through the opened one-way valve 240 and internal conduit 244 where the ink passes through the outlet of internal conduit 244 in direction 472, replenishing manifold 204. A similar operation may be performed to withdraw ink that may leak into the external ink reservoir 232 during operation.

The negative pressure applied by the pump 158 is sufficient to open the one-way valve 240 and to withdraw the purged ink 426 from the receptacle 232 to the ink manifold 204. The negative pressure applied by the pump 158 is also low enough to prevent air bubbles from crossing the receptacle filter 236. In the embodiment of FIG. 4, the meniscus strength of ink wetting the receptacle filter 236 is sufficient to prevent air bubbles from forming in the purged ink for negative pressures with a magnitude of less than 0.6 psi.

In both of the exemplary inkjet printing apparatuses 100 and 200, ink is supplied and withdrawn using a single conduit 160 in fluid communication with a port extending through the ink reservoir of each inkjet printing apparatus. Both inkjet printing apparatus 100 and inkjet printing apparatus 200 place an ink receptacle in selective fluid communication with an ink reservoir using a one-way valve to impede ink from flowing out of the ink reservoir. Additionally, during operation, filters 128 and 136 in inkjet printing apparatus 100 and receptacle filter 236 in inkjet printing apparatus 200 are each wetted with ink, forming a meniscus that impedes the formation of air bubbles within the ink reservoirs of inkjet printing apparatus 100 and inkjet printing apparatus 200, respectively.

Figure 5:
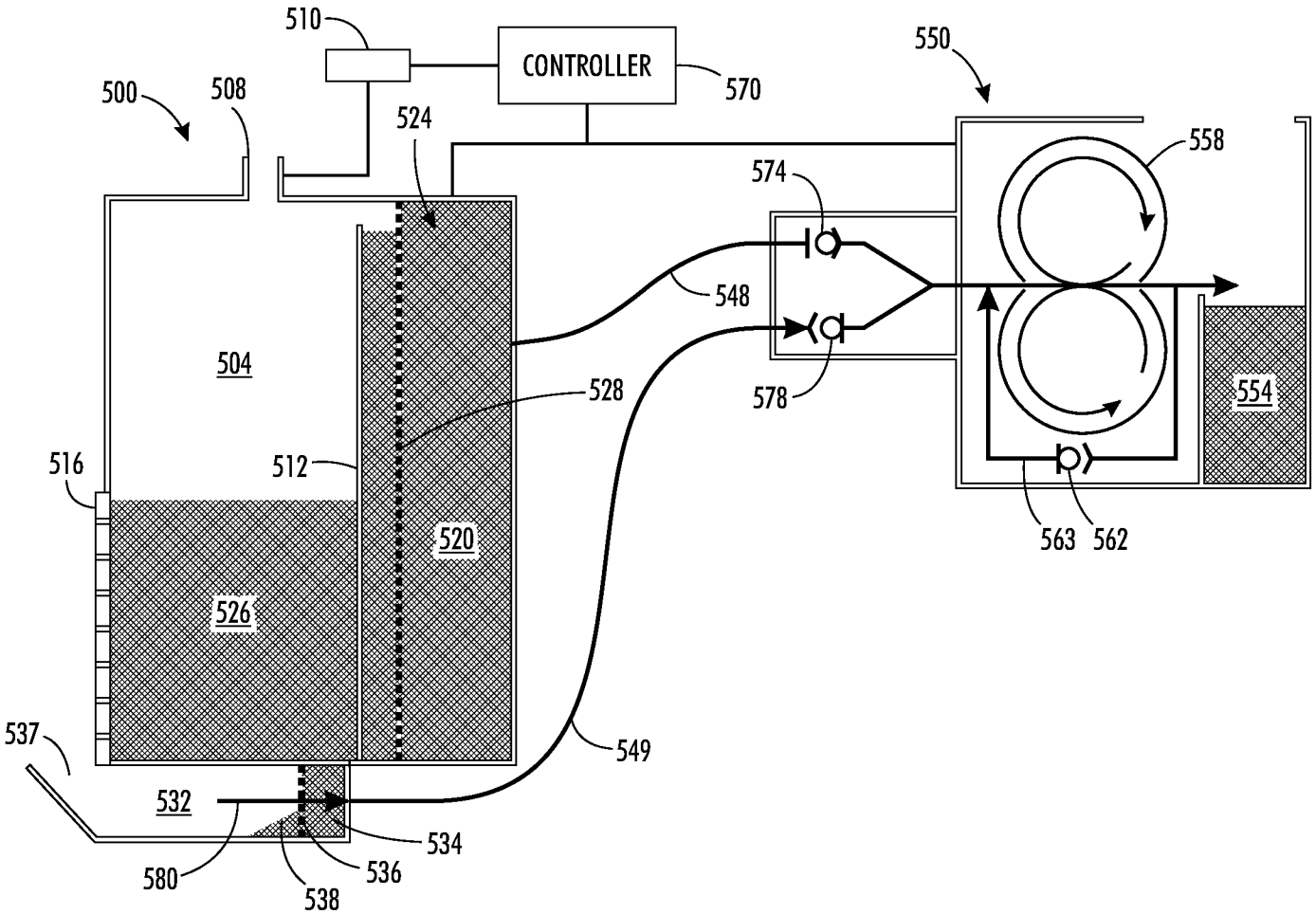
FIG. 5 is a schematic diagram of an inkjet printing apparatus that is operatively connected to an ink supply by two conduits.

FIG. 5 depicts an alternative inkjet printing apparatus 500 and ink supply 550 employing two ink umbilicals. Inkjet printing apparatus 500 shares some features with inkjet printing apparatus 100 including a vent 508 operatively connected to an actuator 510, and a weir 512 that separates an ink inlet chamber 520 from an ink manifold 504 that holds ink 526 for ejection through inkjet ejectors 516. Ink supply 550 also includes a reversible gear pump 558 for pumping ink to and from an ink reservoir 554, and includes an optional bypass relief valve 562 and bypass relief fluid path 563. Inkjet printing apparatus 500 also includes a reservoir filter 528 located between weir 512 and a reservoir ink conduit 548, with ink 524 passing through filter 528 and overflowing weir 512 to supply manifold ink 526. In a similar manner to FIG. 1, controller 570 operates printing apparatus 500 and ink supply 550 to purge ink 526 through the ejectors 516 where the ink flows into an inlet 537 of an ink receptacle 532 attached to the inkjet printing apparatus 500. Pump 558 may withdraw ink in the ink receptacle 532 through a receptacle conduit 549. In the embodiment of FIG. 5, reservoir conduit 548 and receptacle conduit 549 are two separate ink umbilicals.

In the embodiment of FIG. 5, conduits 548 and 549 fluidly communicate with the ink supply 540 through check valves 574 and 578, respectively. Check valve 574 closes when pump 558 applies an insufficient magnitude of positive pressure, and check valve 578 biases closed when pump 558 applies an insufficient magnitude of negative pressure. Alternative embodiments may omit check valve 574, allowing pump 558 to withdraw a small quantity of ink from ink inlet 520 when operating in the reverse mode.

Check valves 574 and 578 may experience a degree of leakage even when biased closed. Pump 558 may urge some ink into conduit 549 and the receptacle 532 during forward operation of the pump. Some of the leaked ink may enter receptacle 532 and become part of ink volume 534 held behind a porous membrane 536. Some of the leaked ink may pass through membrane 536 and be retained in the ink collection volume 538 of the ink receptacle.

FIG. 5 depicts a condition where a portion of ink 534 held behind membrane 536 leaks into the receptacle 532 through pores in the membrane 536. The leaked ink 538 may be present in the receptacle even when the receptacle is substantially free of purged ink. FIG. 5 shows pump 558 operating in a reverse mode to open check valve 578 and apply negative pressure to receptacle 532 through conduit 549. The leaked ink 538 is withdrawn through porous membrane 536 as shown by arrow 580 in response to the negative pressure. The magnitude of the negative pressure is insufficient to overcome the meniscus strength of ink 534 that wets the pores of membrane 536, preventing air from crossing the porous membrane 536. Ink flows from ink reservoir 554 through bypass relief path 563 and opens bypass relief valve 562 to return to the ink reservoir through the pump 558. Bypass relief path 563 and bypass relief valve 562 form a flow restrictor that establishes a predetermined negative pressure level for the pump 558 that is below the pressure needed to draw air past filter 536 when pump 558 operates in the reverse mode. Surface tension between the ink and porous membrane 536 holds ink in contact with the porous membrane 536 after the leaked ink 538 is withdrawn. Thus, leaked ink 538 withdraws across the porous membrane 536, while air in the ink receptacle 532 does not cross porous membrane 536. In the example of FIG. 5, a magnitude of negative pressure appropriate for withdrawing leaked ink 538 that is also below the meniscus strength of ink on porous membrane 536 is 0.4 psi.

While ink supply 550 includes a gear pump configured to apply an appropriate level of negative pressure, alternative pumping mechanisms configured to supply similar levels of negative pressure may also be used. As described in more detail below, pump 550 may periodically operate in the reverse direction for predetermined lengths of time to withdraw leaked ink 538 from ink receptacle 532.

Figure 6:
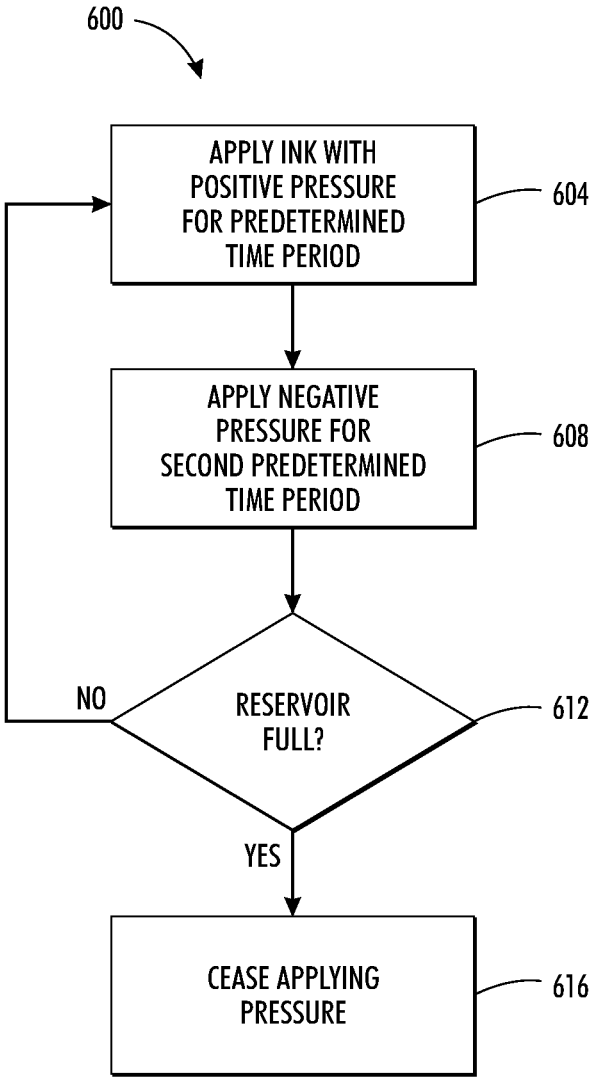
FIG. 6 is a block diagram of a process for supplying ink to an ink reservoir while controlling an amount of ink entering a receptacle.

FIG. 6 depicts a flow diagram of a process 600 for supplying ink to an inkjet printing apparatus while reclaiming ink in an ink receptacle. Process 600 applies positive pressure to supply ink to a port of an ink reservoir in an inkjet printing apparatus for a predetermined time period (block 604). As seen in inkjet printing apparatuses 100, 200, and 500, the ink reservoir may include an intermediate chamber such as inlet chamber 120, or ink may directly flow into a manifold reservoir such as manifold 204. A pump may apply the positive pressure and ink may flow through a conduit such as an ink umbilical operatively connected to a port in the ink reservoir. A controller may set the predetermined period of time, and the predetermined period of time may be determined by a number of factors including the rate of ink flow and volume of ink to be transferred to the ink reservoir. In one embodiment, the pump applies positive pressure in time increments of nine seconds.

The pump applies negative pressure at predetermined intervals (block 608). This negative pressure withdraws ink which may leak into a receptacle that is additionally configured to hold purged ink. Ink may leak through a one-way valve as shown in FIG. 1 or FIG. 2, or through a membrane as shown in FIG. 5. In embodiments using a single conduit such as FIG. 1 or FIG. 2, the pump applies negative pressure to an ink reservoir through the conduit. In alternative embodiments using multiple conduits, such as FIG. 5, the pump applies negative pressure to the ink receptacle through a conduit operatively connected to the receptacle. The amount of negative pressure applied is regulated to be high enough to withdraw the ink, while also being low enough to avoid forming gas bubbles in the ink held in the ink reservoir. A pump that supplies the positive pressure may operate in a reverse direction to apply the negative pressure.

The negative pressure is applied for a predetermined time period that is typically shorter than the time period for applying positive pressure. In one embodiment, negative pressure is applied for one second after a nine second application of positive pressure, while in another embodiment the pump applies negative pressure for one second after applying positive pressure for fourteen seconds. The duration and frequency of negative pressure applications reduce the accumulation of leaked ink in the ink collection area of the ink receptacle.

Process 600 determines if the ink reservoir in the inkjet printing apparatus is full (block 612). Fluid level sensors placed within the reservoir may determine when the reservoir is full, or the reservoir may be considered full once a predetermined volume of ink is pumped into the reservoir. If the identified level of ink in the reservoir indicates that the reservoir is full, then pressure is no longer applied (block 616). If the identified level of ink indicates that the reservoir is not full, the pump may apply positive pressure to supply more ink (block 604).

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A system for delivering liquid ink in an inkjet printing apparatus comprising:

an inkjet printing apparatus configured with an ink reservoir for storing liquid ink to be ejected by the inkjet printing apparatus, a plurality of inkjet ejectors in fluid communication with the ink reservoir, each inkjet ejector configured to receive ink from the ink reservoir and eject ink from an aperture formed in each inkjet ejector;

a receptacle mounted proximate to the plurality of inkjet ejectors that is configured to receive ink purged from the ink reservoir through the plurality of inkjet ejectors, the receptacle having an outlet that is fluidly connected to the ink reservoir, the ink reservoir having a port that enables ink to flow into the ink reservoir and ink to be pulled from the ink reservoir;

a one-way valve positioned in the outlet of the receptacle, the one-way valve being configured to enable the ink in the receptacle to flow into the ink reservoir and to resist a flow of ink from the ink reservoir into the receptacle through the outlet of the receptacle;

a container of liquid ink having an inlet to receive liquid ink and an outlet to supply the liquid ink to the ink reservoir;

a conduit fluidly connected to the port of the ink reservoir and to the outlet of the liquid ink container;

a pump operatively connected to the conduit and configured for reversible operation; and a controller operatively connected to the pump and configured to operate the pump in a first direction to supply ink from the container of liquid ink to the ink reservoir through the port and to operate the pump in the second direction to generate negative pressure at the port of the ink reservoir to open the one-way valve and pull ink from the receptacle into the ink reservoir through the outlet of the receptacle.

2. The ink delivery system of claim 1 further comprising:

a weir extending from a floor of the ink reservoir to a position within the ink reservoir that divides the ink reservoir into a first chamber and a second chamber; and a membrane having pores that is positioned in the first chamber of the ink reservoir between the weir and the port in the ink reservoir, the membrane being configured to enable ink to pass through the pores at a first pressure and to enable air to pass through the pores at a second pressure that is greater in magnitude than the first pressure.

3. The ink delivery system of claim 2 further comprising:

a flow restrictor operatively connected to the conduit at a first position between the membrane and the pump and operatively connected at a second position to the ink container, the flow restrictor being configured to enable ink flow from the ink container to the first position through a second fluid flow path to establish a pressure at the membrane that is between the first pressure and the second pressure.

4. The ink delivery system of claim 1 wherein the controller is further configured to operate the pump in the first direction to pump ink into the ink reservoir for a first predetermined time period and to operate the pump in the second direction to pull ink from the receptacle into the ink reservoir for a second predetermined period of time.

5. The ink delivery system of claim 4 wherein the second predetermined time period is shorter than the first predetermined time period.

6. The ink delivery system of claim 1 further comprising:

a vent;

an actuator operatively connected to the vent to open the vent to atmospheric pressure; and the controller being operatively connected to the actuator and further configured to operate the actuator selectively to open the vent and enable the plurality of inkjet ejectors to pull ink from the ink reservoir and eject the ink from the inkjet printing apparatus.

7. The ink delivery system of claim 6 further comprising:

a second conduit extending from the one-way valve to a predetermined position in the ink reservoir.

8. The ink delivery system of claim 7 wherein the predetermined position is above a full level in the ink reservoir.

9. The ink delivery system of claim 7 further comprising:

a filter positioned within the ink reservoir at a location between the outlet of the receptacle and the plurality of inkjet ejectors.

10. The ink delivery system of claim 9 wherein the filter is positioned at an inlet to the plurality of inkjet ejectors to filter ink pulled from the ink reservoir before the ink enters the plurality of inkjet ejectors.

11. The ink delivery system of claim 1 further comprising:

a wall extending across a width of the ink reservoir and from a floor of the ink reservoir to a predetermined position that is less than a height of the ink reservoir; and a filter extending across the width of the ink reservoir and from the floor of the ink reservoir to a ceiling of the ink reservoir, the port and the outlet of the receptacle being positioned on one side of the filter and the wall being positioned on an opposite side of the filter.

12. The ink delivery system of claim 11 further comprising:

a second filter positioned in the receptacle to filter ink purged from the plurality of inkjet ejectors before the ink is pulled into the ink reservoir through the outlet of the receptacle.

* * * * *